US008966757B2

(12) United States Patent
Lee et al.

(10) Patent No.: US 8,966,757 B2
(45) Date of Patent: Mar. 3, 2015

(54) PLASTIC HEAT EXCHANGER AND METHOD OF MANUFACTURING THE SAME

(75) Inventors: Eon-seok Lee, Daejeon (KR); Ho-geun Ryu, Daejeon (KR); Du-soon Choi, Daejeon (KR); Sang-Hoon Han, Daejeon (KR)

(73) Assignee: LG Chem, Ltd. (KR)

( * ) Notice: Subject to any disclaimer, the term of this patent is extended or adjusted under 35 U.S.C. 154(b) by 983 days.

(21) Appl. No.: 12/310,153

(22) PCT Filed: Jul. 31, 2007

(86) PCT No.: PCT/KR2007/003674

§ 371 (c)(1),
(2), (4) Date: Aug. 27, 2009

(87) PCT Pub. No.: WO2008/018712

PCT Pub. Date: Feb. 14, 2008

(65) Prior Publication Data

US 2010/0012304 A1 Jan. 21, 2010

(30) Foreign Application Priority Data

Aug. 11, 2006 (KR) ..... 10-2006-0076295

(51) Int. Cl.

| | |
|---|---|
| ***F16L 41/02*** | (2006.01) |
| ***F28F 9/18*** | (2006.01) |
| ***F28D 1/053*** | (2006.01) |
| ***F28F 21/06*** | (2006.01) |
| *F28D 21/00* | (2006.01) |

(52) U.S. Cl.

CPC ..... *F28F 9/182* (2013.01); *F28D 1/05333* (2013.01); *F28D 2021/007* (2013.01); *F28F 9/187* (2013.01); *F28F 21/062* (2013.01); *F28F 2255/16* (2013.01); *F28F 2255/143* (2013.01)

USPC ..... 29/890.03; 29/890.1; 29/890.142; 29/890.143

(58) Field of Classification Search

USPC ..... 29/890.03, 890.038, 890.04, 890.046, 29/510, 512, 515; 264/248, 249, 263, 296

See application file for complete search history.

(56) References Cited

U.S. PATENT DOCUMENTS

| | | | | |
|---|---|---|---|---|
| 4,790,372 | A * | 12/1988 | Gemeinhardt et al. | 165/173 |
| 5,067,235 | A | 11/1991 | Kato et al. | |
| 5,415,443 | A * | 5/1995 | Hayashi | 285/405 |
| 6,554,929 | B2 | 4/2003 | Lee | |
| 2002/0088526 | A1 * | 7/2002 | Lee | 156/73.1 |
| 2007/0012424 | A1 * | 1/2007 | Kamiya et al. | 165/81 |

FOREIGN PATENT DOCUMENTS

| | | | |
|---|---|---|---|
| EP | 0140069 | A2 | 5/1985 |
| GB | 1225628 | A | 3/1971 |
| GB | 2273459 | A | 6/1994 |
| JP | 52-097945 | U | 7/1977 |
| JP | 54-178161 | U | 12/1979 |
| JP | 62-142998 | A | 6/1987 |
| JP | 7-117134 | A | 5/1995 |
| JP | 2002-225138 | A | 8/2002 |

OTHER PUBLICATIONS

Office Action from Taiwanese Application No. 96128595 dated May 21, 2010. (References on Office Action were previously made of record).

International Search Report issued on Aug. 29, 2007 in connection with corresponding International Appln. No. PCT/KR2007/003674.

European Search Report issued on Aug. 1, 2013 in corresponding European Patent Application No. 07793329.9.

* cited by examiner

*Primary Examiner* — Christopher Besler

(74) *Attorney, Agent, or Firm* — Lerner, David, Littenberg, Krumholz & Mentlik, LLP

(57) ABSTRACT

Disclosed is a plastic heat exchanger in which, when a heat exchanger tube of the plastic heat exchanger is coupled to a header, the heat exchanger tube and a junction portion of the header are melted and pressed simultaneously through a heat fusion jig including a fusion portion and a fusion valley so as to secure reliability against leakage of refrigerant, and a method of manufacturing the same, by which the plastic heat exchanger can be mass-produced at low fabricating cost through simple processes. The present invention provides a method of fabricating a plastic heat exchanger, comprising a step of melting and pressing a plastic heat exchanger tube and a junction of a header by using a heat fusion jig, and a plastic heat exchanger fabricated by the method, thereby securing reliability against leakage of refrigerant, having heat exchange performance more excellent than or equal to a metallic heat exchanger and also mass-producing the plastic heat exchanger at low fabricating cost through simple processes.

3 Claims, 7 Drawing Sheets

PLASTIC HEAT EXCHANGER AND METHOD OF MANUFACTURING THE SAME

CROSS REFERENCE TO RELATED APPLICATIONS

The present application is a national phase entry under 35 U.S.C. §371 of International Application No. PCT/KR2007/003674, filed Jul. 31, 2007, published in English, which claims priority from Korean Patent Application No. 10-2006-0076295, filed Aug. 11, 2006, all of which are incorporated herein by reference.

TECHNICAL FIELD

The present invention relates to a plastic heat exchanger and a method of manufacturing the same, and particularly, to a plastic heat exchanger in which, when a heat exchanger tube of the plastic heat exchanger is coupled to a header, the heat exchanger tube and a junction portion of the header are melted and pressed simultaneously through a heat fusion jig including a fusion portion and a fusion valley so as to secure reliability against leakage of refrigerant, thereby having heat exchange performance more excellent than or equal to a metallic heat exchanger, and a method of manufacturing the same, by which the plastic heat exchanger can be mass-produced at low fabricating cost through simple processes.

BACKGROUND ART

In a general heat exchanger, as shown in FIG. 1, a heat exchanger fin 3 is attached to an external side of a metallic heat exchanger tube including a refrigerant inlet pipe 1 and a refrigerant outlet pipe 2 to improve heat transfer, and a header made of a metallic material is coupled to left and right sides of the metallic heat exchanger tube to fix the heat exchanger. The heat exchanger is made of an expensive metallic material such as aluminum alloy, copper and the like and fabricated through complicated processes, thereby increasing fabrication time and cost. Thus, it is difficult to mass-produce the heat exchanger.

Meanwhile, in order to solve the problem, there was proposed a joint method between a tube and a tube header for a plastic heat exchanger (Korean Patent No. 10-0366430), in which the heat exchanger was made of a plastic material and the tube and header were fused to each other by an inverted triangular mold using heat fusion. However, in this method, because the tube and header are not fused integrally to each other with deformation of their original shapes, but simply joined by heat of the mode using heat fusion, it is difficult to maintain airtightness of refrigerant which is essentially required in the heat exchanger, and thus because it is impossible to maintain a refrigerant pressure of a condenser in a refrigeration cycle and also the refrigeration cycle is not formed normally, thereby deteriorating performance of the heat exchanger.

DISCLOSURE OF INVENTION

Technical Problem

An object of the present invention is to provide a plastic heat exchanger in which, when a heat exchanger tube of the plastic heat exchanger is coupled to a header, the heat exchanger tube and a junction portion of the header are melted and pressed simultaneously through a heat fusion jig including a fusion portion and a fusion valley so as to secure reliability against leakage of refrigerant, thereby having heat exchange performance more excellent than or equal to a metallic heat exchanger, and a method of manufacturing the same, by which the plastic heat exchanger can be mass-produced at low fabricating cost through simple processes.

Technical Solution

To achieve the object, there is provided a method of fabricating a plastic heat exchanger, comprising a tube coupling step for coupling the heat exchanger to the header, a heat fusion step for melting and pressing the heat exchanger tube coupled to the header by using heat, and a header coupling step for coupling the header cap to the header which is joined to the plastic heat exchanger tube, wherein the plastic heat exchanger tube and a junction of the header are melted and joined by using a heat fusion jig.

Preferably, the junction of the header comprises a fusion bead which is coupled to the plastic heat exchanger tube and then melted by heat; and a melted material inflow groove which is formed along an outer circumferential surface of the fusion bead so that the melted material is inflowed therein. Thus, the plastic heat exchanger tube and the header can be firmly joined to each other, thereby securing the air-tightness of refrigerant.

Preferably, the melted material inflow groove is formed to have a predetermined width w and a predetermined angle θ so as to prevent the leakage of the melted material and firmly join the melted material and also firmly form a shape after the fusing process.

Preferably, the heat fusion jig comprises an insertion portion which is formed into a conical shape so be smoothly inserted into the plastic heat exchanger tube; a body which has an outer diameter corresponding to an inner diameter of the plastic heat exchanger tube so as to maintain an internal shape of the plastic heat exchanger tube upon the heat-fusing process; a fusion portion which is formed at an upper portion of the body to be inclined at a predetermined angle so that the melted material of the heat exchanger tube and the fusion bead can be smoothly inflowed into the melted material inflow groove; and a fusion valley which is joined to the melted material inflow groove to prevent a leakage of the melted material and which forms a shape after the joining process.

Preferably, a plastic heat exchanger which is fabricated by heat-fusing a plastic heat exchanger tube and a header using a heat fusion jig comprises a fusion bead which is joined to a junction of the header and then melted together with an end of the heat exchanger tube by heat; and a melted material inflow groove which is formed along an outer circumferential surface of the fusion bead so that melted material is inflowed therein.

Preferably, the plastic heat exchanger according to claim 5, wherein the heat fusion jig comprises an insertion portion which is formed into a conical shape; a cylindrical body which has an outer diameter corresponding to an inner diameter of the heat exchanger tube; a fusion portion which is formed at an upper portion of the body to be inclined at a predetermined angle; and a fusion valley which is joined along the melted material inflow groove of the header to prevent a leakage of the melted material.

Advantageous Effects

According to the present invention, since the heat exchanger tube and the header can be firmly coupled, there are some advantages of securing reliability against leakage of refrigerant, having heat exchange performance more excellent than or equal to a metallic heat exchanger and also mass-producing the plastic heat exchanger at low fabricating cost through simple processes.

BRIEF DESCRIPTION OF THE DRAWINGS

The above and other objects, features and advantages of the present invention will become apparent from the following description of preferred embodiments given in conjunction with the accompanying drawings, in which.

BRIEF DESCRIPTION OF MAIN ELEMENTS

Figure 1:
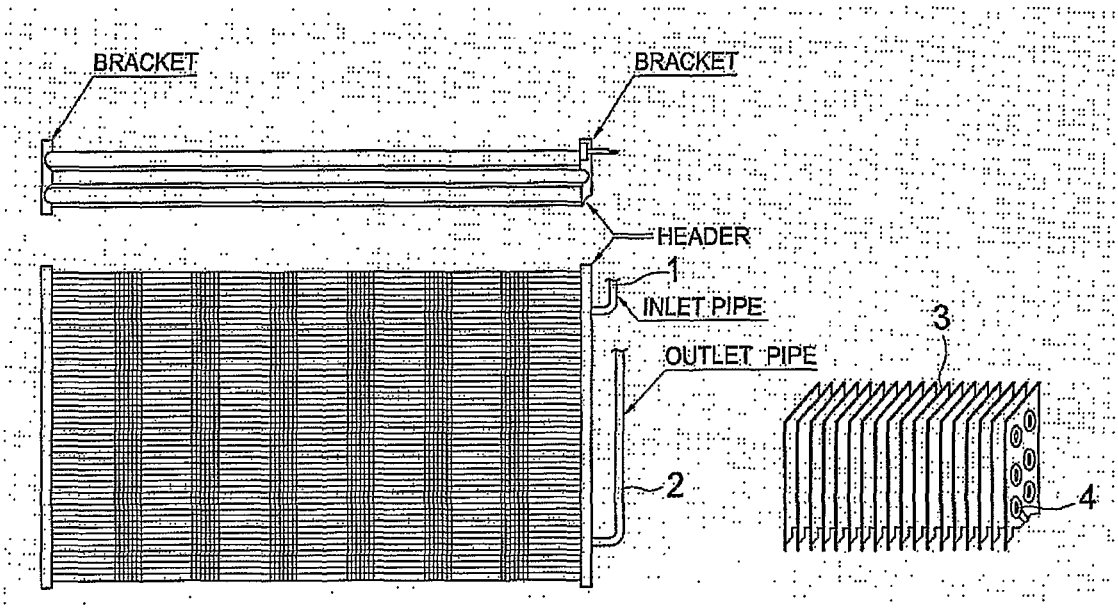
FIG. 1 is a view showing a structure of a conventional heat exchanger made of a metallic material.

1: refrigerant inlet tube 2: refrigerant outlet tube
3: heat exchanger fin 4: copper heat exchanger tube
5: plastic heat exchanger tube 6: header
6*a*: fusion bead 6*b*: melted material inflow groove
7: header cap 8: heat fusion jig
8*a*: insertion portion 8*b*: body
8*c*: fusion portion 8*d*: fusion valley Best Mode for Carrying out the Invention Hereinafter, the embodiments of the present invention will be described in detail with reference to accompanying drawings.

Figure 2:
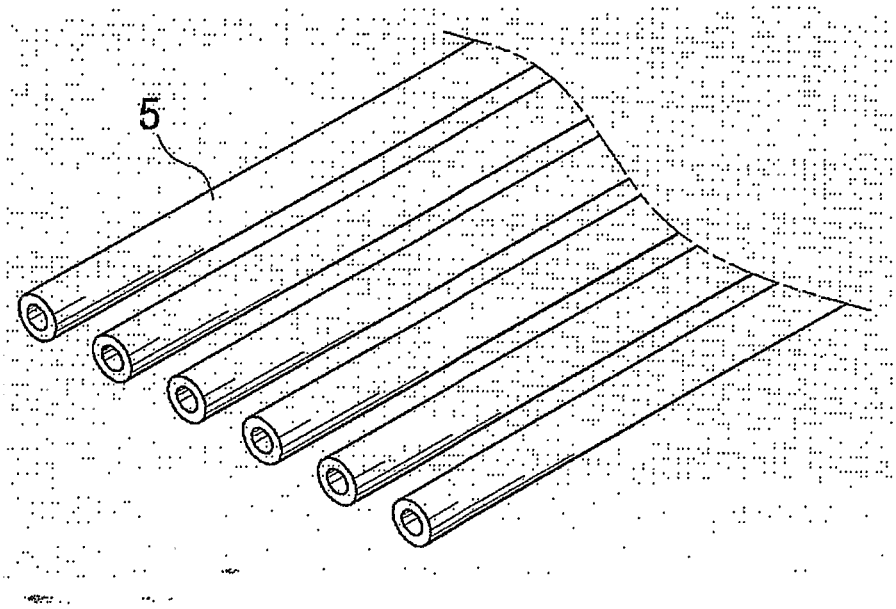
FIG. 2 is a perspective view of a plastic heat exchanger tube according to the present invention.
Figure 3:
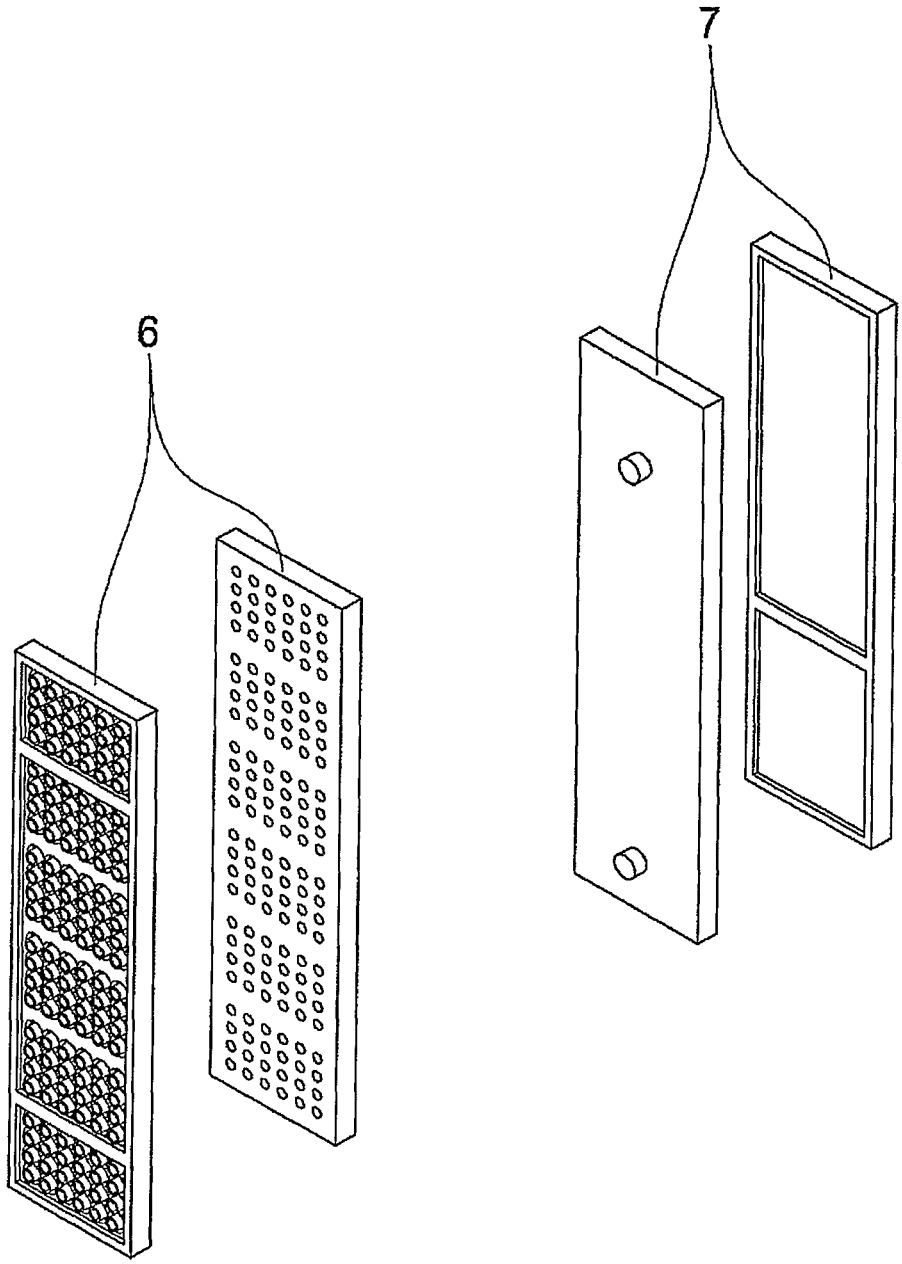
FIG. 3 is a perspective view of a header and a header cap according to the present invention.

FIG. 2 is a perspective view of a plastic heat exchanger tube according to the present invention and FIG. 3 is a perspective view of a header and a header cap according to the present invention, wherein the heat exchanger tube 5 made of a plastic material is formed by an extrusion process and the header 6 and header cap 7 is formed by an injection process. In the extrusion process, a raw material is supplied to an extruder and then extruded by a mold having a predetermined shape and diameter to be molded into a continuous body having a desired shaped section. The extrusion process is proper for mass-production and has an advantage of forming various shapes.

Further, in the injection process, first of all, an injection mold having a pre-determined shape is prepared, and resin like melted plastic is filled therein and then solidified to form a production. The injection process is also proper for mass-production at low fabricating cost.

Figure 4:
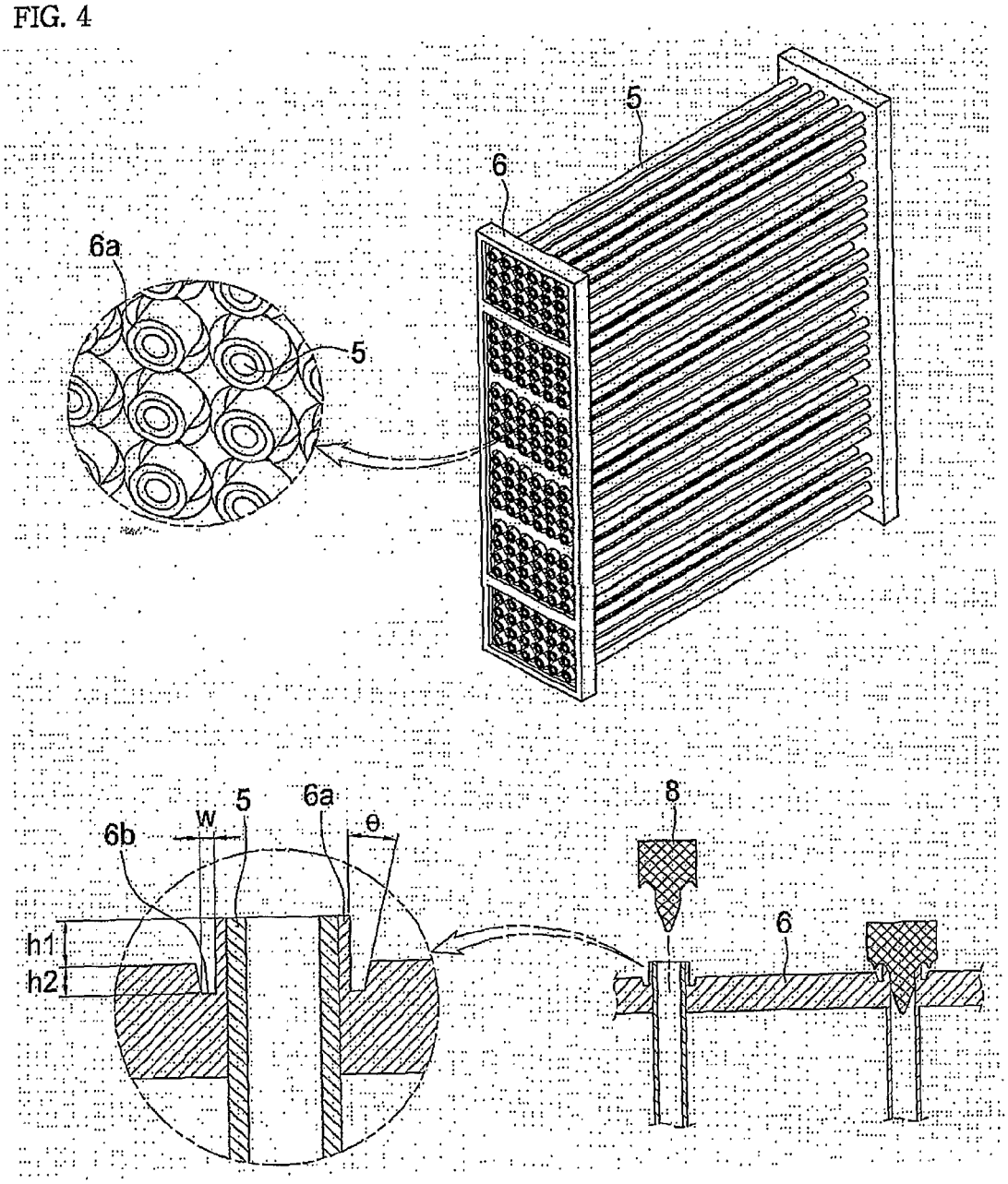
FIG. 4 shows a perspective view and a cross-sectional view of a junction portion of the header according to the present invention.
Figure 5:
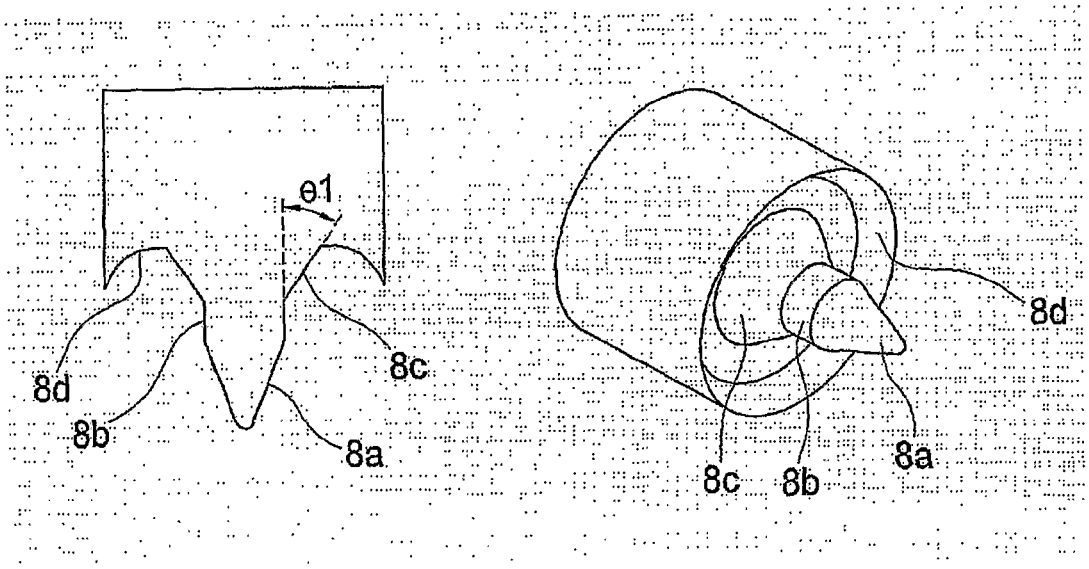
FIG. 5 is a perspective view of a fusion jig according to the present invention.

FIG. 4 shows a perspective view and a cross-sectional view of a junction portion of the header according to the present invention and FIG. 5 is a perspective view of a fusion jig according to the present invention. The drawings show a status that the plastic heat exchanger tube 5 is coupled to the junction portion of the header 6 before being melted, a melting and joining process using a heat fusion jig 8 and a detailed structure of the heat fusion jig 8. That is, the drawings are to help explain the plastic heat exchanger of the present invention and the method of fabricating the same, which comprises a tube coupling step B for coupling the heat exchanger to the header and a heat fusion step C for melting and pressing the heat exchanger tube coupled to the header by using heat. In the tube coupling step B and the heat fusion step C according to the present invention, the plastic heat exchanger tube 5 formed by the extrusion process is coupled to the junction portion of the header 6 formed by the injection process, and the junction portion is melted and pressed simultaneously through the heat fusion jig 8. Thus, the heat exchanger tube 5 and the header 6 are completely heat-fused to each other.

The junction portion of the header 6 is formed with a fusion bead 6*a* which is melted together with the plastic heat exchanger tube 5 by the heat. Therefore, when the junction portion of the header 6 and the heat exchanger tube 5 are fused by the heat fusion jig 8, the joining therebetween becomes firm. In the above process, the melted material of the junction portion between the heat exchanger tube 5 and the header 6 is inflowed into a melted material inflow groove 6*b* formed along an outer circumferential surface of the fusion bead 6*a*. At this time, the melted material is guided by a fusion portion 8*c* of the heat fusion jig 8 so as to be facilely inflowed in the melted material inflow groove 6*b*. By a fusion valley 8*d* of the heat fusion jig 8 which is joined along the melted material inflow groove 6*b*, a leakage is prevented and also a shape after the fusing process can be formed. Thus, the plastic heat exchanger tube 5 and the header 6 can be firmly joined, thereby perfectly maintaining air-tightness for refrigerant.

In addition, as shown in FIG. 4, it is preferable that the melted material inflow groove 6*b* has a predetermined width w and a predetermined angle θ so as to prevent the leakage of the melted material and firmly join the melted material and also firmly form the shape after the fusing process.

As shown in FIGS. 4 and 5, the heat fusion jig 8 for heat-fusing simultaneously the plastic heat exchanger tube 5 and the junction portion of the header 6 is formed with an insertion portion 8*a*, a body 8*b*, a fusion portion 8*c* and a fusion valley 8*d* which are formed integrally. The insertion portion 8*a* is formed to have a conical shape so as to be smoothly inserted into the plastic heat exchanger tube 5 when the plastic heat exchanger tube 5 and the junction portion of the header 6 are heat-fused to each other.

The body 8*b* is formed into a cylinder shape having an outer diameter corresponding to an inner diameter of the plastic heat exchanger tube 5 so as to maintain an internal shape of the plastic heat exchanger tube 5 upon the heat-fusing process.

The fusion portion 8*c* is formed at an upper portion of the body 8*b* to be inclined toward the melted material inflow groove 6*b* so that the melted material of the heat exchanger tube 5 and the fusion bead 6*a* of the header 6 can be smoothly inflowed into the melted material inflow groove 6*b*. Preferably, the inclined angle θ is correspondent to the angle of the melted material inflow groove 6*b*.

Further, the fusion valley 8*d* is joining along the melted material inflow groove 6*b* so as to prevent the leakage of the melted material and also form the shape after the joining process. Herein, the joining shape after the heat fusion process between the plastic heat exchanger tube 5 and the junction of the header 6 is determined according to a shape of an inner valley of the fusion valley 8*d*.

Figure 6:
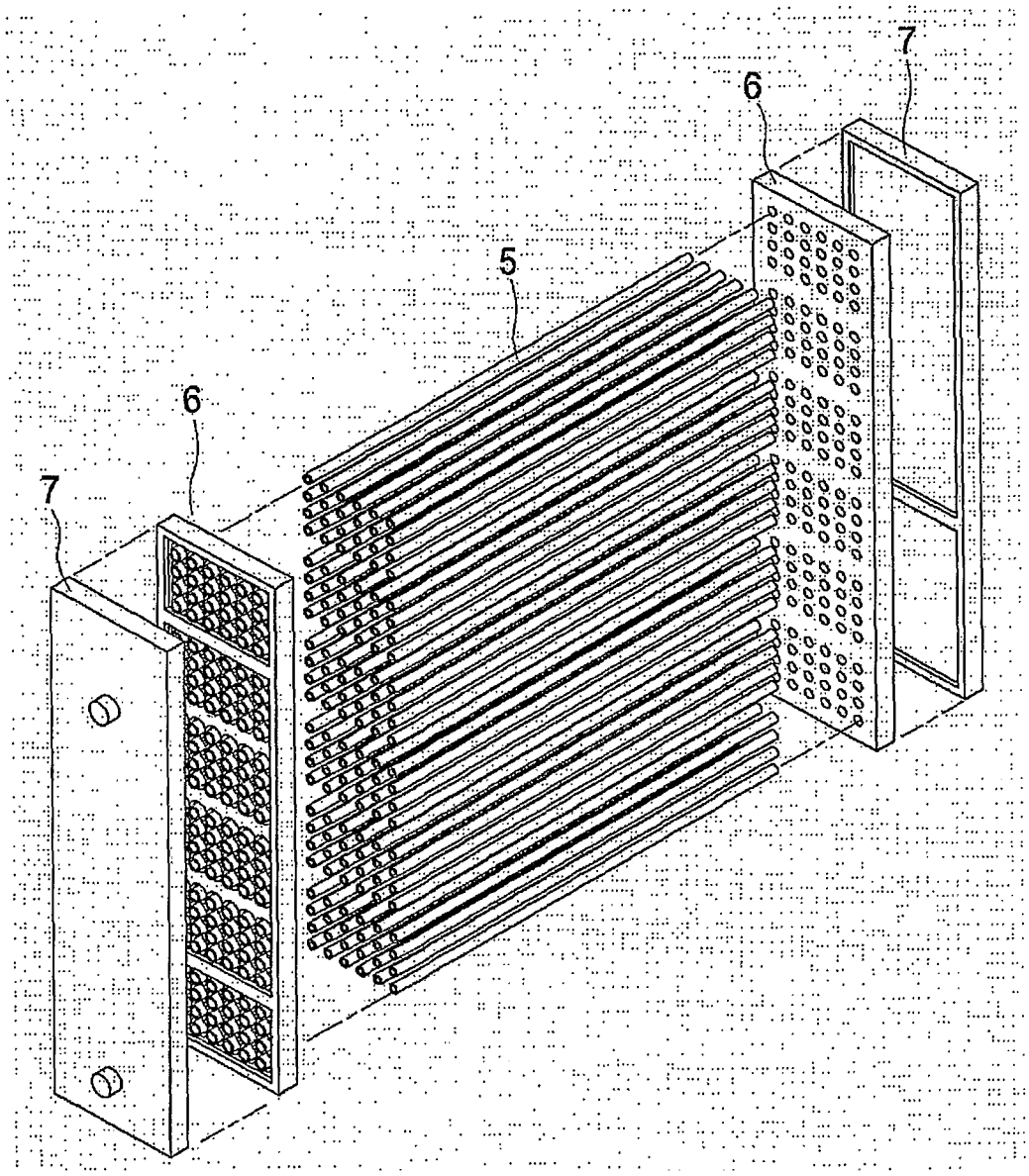
FIG. 6 is a view of assembling the plastic heat exchanger according to the present invention.
Figure 7:
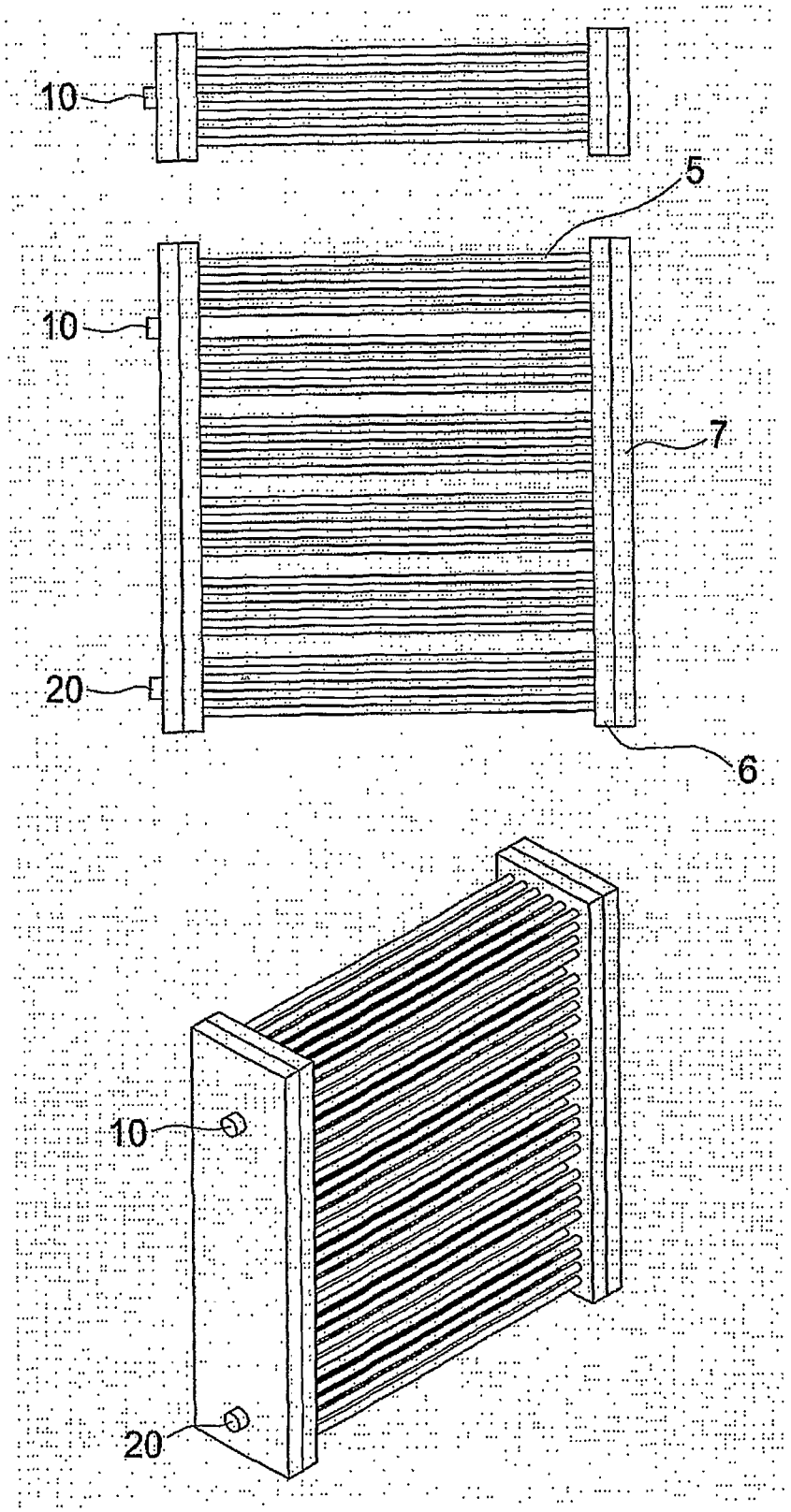
FIG. 7 is a perspective view of the plastic heat exchanger fabricated by a method according to the present invention.

FIG. 6 is a view of assembling the plastic heat exchanger according to the present invention and FIG. 7 is a perspective view of the plastic heat exchanger fabricated by a method according to the present invention. That is, the drawings are to help explain a header coupling step D for coupling the header cap 7 to the header 6 which is joined to the plastic heat exchanger tube 5 of the present invention. Herein, after the plastic heat exchanger tube 5 and the junction portion of the header 6 are coupled to each other and then simultaneously heat-fused by the heat fusion jig 8, the header cap 7 formed by the injection process is fused to the header 6. Various methods such as vibration fusion, high-frequency fusion, heat fusion and the like can be applied to the fusion process between the header cap 7 and the header 6.

FIG. 7 is a perspective view of the plastic heat exchanger fabricated by a method according to the present invention. The drawing shows the plastic heat exchanger having the refrigerant inlet tube 10 and the refrigerant outlet tube 20, which is fabricated by the above-mentioned processes. When the header cap is formed by the injection process, the refrigerant inlet tube 10 and the refrigerant outlet tube 20 are also formed by an insert injection molding process. Therefore, the refrigerant inlet tube 10 and the refrigerant outlet tube 20 are integrally formed with the header cap 7, thereby securing the prevention of leakage of refrigerant.

Industrial Applicability

According to the present invention, since the heat exchanger tube and the header can be firmly coupled, there are some advantages of securing reliability against leakage of refrigerant, having heat exchange performance more excellent than or equal to a metallic heat exchanger and also mass-producing the plastic heat exchanger at low fabricating cost through simple processes.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. A method of fabricating a plastic heat exchanger having an integral structure of a plastic heat exchanger tube, a header and a header cap, comprising:

preparing the header to comprise a junction having a fusion bead and a melted material inflow groove formed along an outer circumferential surface of the fusion bead by injection molding, wherein the fusion bead projects above a surface of the header, and wherein the melted material inflow groove is recessed below the surface of the header;

preparing the header cap to comprise a refrigerant inlet tube and a refrigerant outlet tube by insert injection molding;

coupling the plastic heat exchanger tube and the junction of the header by using a heat fusing jig to provide an integral structure of the plastic heat exchanger tube and the junction of the header, wherein the coupling causes inflow of melted materials into the melted material inflow groove of the junction, wherein the melted materials are melted material from the fusion bead and melted material from the plastic heat exchanger tube; and fusing the header cap onto the header to provide an integral structure of the header cap and the header.

2. The method according to claim 1, wherein the melted material inflow groove is formed to have a predetermined width and a predetermined angle so as to firmly join the melted materials and firmly form a shape after the coupling process.

3. The method according to claim 1, wherein the heat fusion jig comprises:

an insertion portion which is formed into a conical shape to be smoothly inserted into the plastic heat exchanger tube;

a body which has an outer diameter corresponding to an inner diameter of the plastic heat exchanger tube so as to maintain an internal shape of the plastic heat exchanger tube upon the coupling process;

a fusion portion which is formed at an upper portion of the body to be inclined at a predetermined angle so that the melted materials can be smoothly inflowed into the melted material inflow groove; and a fusion valley brought in close proximity to the melted material inflow groove to prevent a leakage of the melted materials and which forms a shape after the coupling process.

* * * * *